United States Patent [19]

Mitze et al.

[11] Patent Number: 4,572,073

[45] Date of Patent: Feb. 25, 1986

[54] SHEET GUIDE ARRANGEMENT IN SHEET-FED MACHINES

[75] Inventors: Rudolf Mitze, Dietzenbach; Claus Simeth, Offenbach am Main, both of Fed. Rep. of Germany

[73] Assignee: M.A.N.-Roland Druckmaschinen Aktiengesellschaft, Fed. Rep. of Germany

[21] Appl. No.: 673,165

[22] Filed: Nov. 19, 1984

[30] Foreign Application Priority Data

Nov. 25, 1983 [DE] Fed. Rep. of Germany ..... 3342663

[51] Int. Cl.[4] ..... B41F 31/00

[52] U.S. Cl. ..... 101/350; 101/419; 101/248; 364/570; 271/254; 271/255

[58] Field of Search ..... 101/350, 419-420, 101/248; 364/570; 271/227, 253, 254, 255; 226/19-20

[56] References Cited

U.S. PATENT DOCUMENTS

| | | | |
|---|---|---|---|
| 2,566,399 | 9/1951 | Bishop | 101/248 |
| 3,177,751 | 4/1965 | Vercauteren | 226/19 |
| 3,184,374 | 5/1965 | Pearson | 226/19 |
| 4,049,213 | 9/1977 | Hank et al. | 226/19 |
| 4,200,932 | 4/1980 | Schramm et al. | 101/350 X |
| 4,390,958 | 6/1983 | Mamberer | 101/350 X |
| 4,428,287 | 1/1984 | Greiner | 101/248 |
| 4,453,708 | 6/1984 | Dennhardt | 101/419 X |
| 4,500,045 | 2/1985 | Whitaker et al. | 226/20 X |

*Primary Examiner*—E. H. Eickholt

*Attorney, Agent, or Firm*—Leydig, Voit & Mayer, Ltd.

[57] ABSTRACT

A system for remote sensing, indicating and remote control provides for the non-smear guidance of sheets through a sheet-fed machine and is especially useful for printing machines which print on both sides of the sheets. Sheet guides are adjustable during machine operation from a control panel at a central location outside of the machine. The positions of the sheet guides are preferably displayed in direct comparison with zones of ink application. Also, the sheet guides are adjustable from the control panel so that the guides fall within the gaps between printed areas on the sheet. An immediate and graphic check of the sheet guides is provided. In a preferred embodiment, the positions of the sheet guides are indicated on a linear array of optical indicators, each indicator representing a respective boundary between adjacent inking zones, and two adjacent ones of the optical indicators being simultaneously activated when one of the sheet guides is adjusted approximately at the center of the inking zone defined by the boundaries represented by the two adjacent ones of the optical indicators.

20 Claims, 5 Drawing Figures

SHEET GUIDE ARRANGEMENT IN SHEET-FED MACHINES

BACKGROUND OF THE INVENTION

1. Technical Field

This invention relates to sheet-fed machines and in particular sheet-fed machines printing on both sides of the fed sheets and having laterally adjustable sheet guides.

2. Description of the Related Art

In a sheet-fed machine, the sheets are held and guided in their path by various sheet guides so that the sheets may be reliably conveyed through the machine without flapping.

When the sheet guide means need to be adjusted to a different position by the machine operator for one reason or another, the sheet-fed machine has to be switched off. The sheet guides in the machine are practically never accessible to the operating staff, so that at least two workers have to cooperate on call in order to be able to adjust the sheet guides. In the usual case the guides are adjusted in accordance with the printed text conditions at any given time, in order that the guides contact the sheets only at non-printing areas to avoid smearing of the sheets. After alignment, a test run has to be carried out to check the effect of the adjustment. Depending on the result, further re-adjustment with the machine switched off may have to be carried out. An appreciable loss of time during printing and an additional responsibility for the operating staff therefore result.

West German Patent (DE-AS) No. 1,561,101 published Jan. 8, 1970 discloses a sheet guide system for sheet guide cylinders in multi-colour sheet-fed rotary printing machines. To avoid smearing of the freshly printed surface this system comprises, beneath the printing cylinder and the sheet guide cylinder, a number of hollow sheet guide stirrups with air exit apertures. The sheet guide means in the form of retaining discs are axially displaceable on the sheet guide cylinder. The sheet guide means can thus be disposed at those places where there is no ink applied to the sheet. The object of this system is correct-register guidance of the sheet end when the front edge of the sheet has already been released, allowing for the format adjustment in the case of continuous printing and intermittent operation.

Another problem in the setting-up and adjustment of the sheet guides in more recent machines is that the sheet guides are covered by plates and hoods so that they can no longer be seen directly from outside, i.e. accessibility of the sheet guide means in the recent machines is very much poorer than in the older machines.

As a result of these deficiencies, operating staff are usually compelled to go into or beneath the sheet-fed machine in order to carry out the adjustment operation. Corrections are usually necessary in succession for the above-mentioned reasons of difficulty, resulting in considerable down-time or loss of time for continuous printing.

In the case of sheet guide wheels, it was, for example, a complex procedure first to release a retaining pin and then shift the wheels on their mounting shaft. The retaining pin then had to be relocked to enable the sheet guide rollers to be rigidly secured in the required position on the shaft in order to avoid print smearing.

This procedure of adjustment and alignment with the machine stationary was very time-consuming and difficult to perform.

SUMMARY OF THE INVENTION

Accordingly, the primary object of the invention is to enable sheet guide means to be quickly adjusted laterally to the gaps between printed areas.

Another object of the invention is to enable sheet guides to be easily adjusted by a single operator at a central location or control panel outside of the printing machine.

In accordance with the primary aspect of the invention, the sheet guide means are adjustable by remote control either by motor or manually during machine operation from an external location, such as on or near the sheet-fed printing machine or from an evaluation table, and the position of the sheet guide means are displayed in direct comparison with the ink application, so that the sheet guide means are adjustable at the external location to be within the gaps between the printed areas of the sheet.

The adjustment can be carried out by a single operator without direct visibility and accessibility to the sheet guide means. There is no time-consuming stopping of the machine. There is no need for any check when the machine restarts and hence a considerable number of spoiled sheets are eliminated.

In a preferred embodiment, the sheet guides in the form of rods are secured to respective drive blocks which together with the sheet guide rods are mounted for lateral traversing on a cross-member. Each drive block is provided with a gear or pinion engaging a toothed rack fixed to the cross-member, and the gear is driven by a motor mounted on the drive block. Alternatively, the gear is driven by a flexible shaft or Bowden cable manually powered by an external hand lever or wheel. Hydraulic, pneumatic, or other adjustment means operated by fluid pressure could also be substituted.

Preferably, the drives are controlled from any desired position outside the machine. As a reference for the adjustment, a scale strip is provided indicating the inking zones, next to or along with light-emitting diodes (LED's) or other display means for correlating the lateral position of the sheet guide means with the respective inking zones. The adjustment of the sheet guide means can be carried out at each individual machine tower or from a central control panel. In the case of multi-colour printing machines, however, the adjustment is preferably carried out directly in front of each plate cylinder while in the case of two-colour perfecting it is preferably carried out from a central adjustment for both plate cylinders. In that case the printed sheet is available as a reference and the printer can carry out the adjustment of all the sheet guide means in the machine by reference to the printed text and the LED strip or the scale strip.

BRIEF DESCRIPTION OF THE DRAWINGS

Other objects and advantages of the invention will become apparent from the following detailed description and the accompanying drawings, in which.

While the invention will be described in connection with certain preferred embodiments, it will be understood that it is not intended to limit the invention to the particular forms shown. On the contrary, it is intended to cover all modifications, alternatives, and equivalents as may be included within the spirit and scope of the invention as defined by the appended claims.

DETAILED DESCRIPTION OF THE PREFERRED EMBODIMENTS

Figure 1:
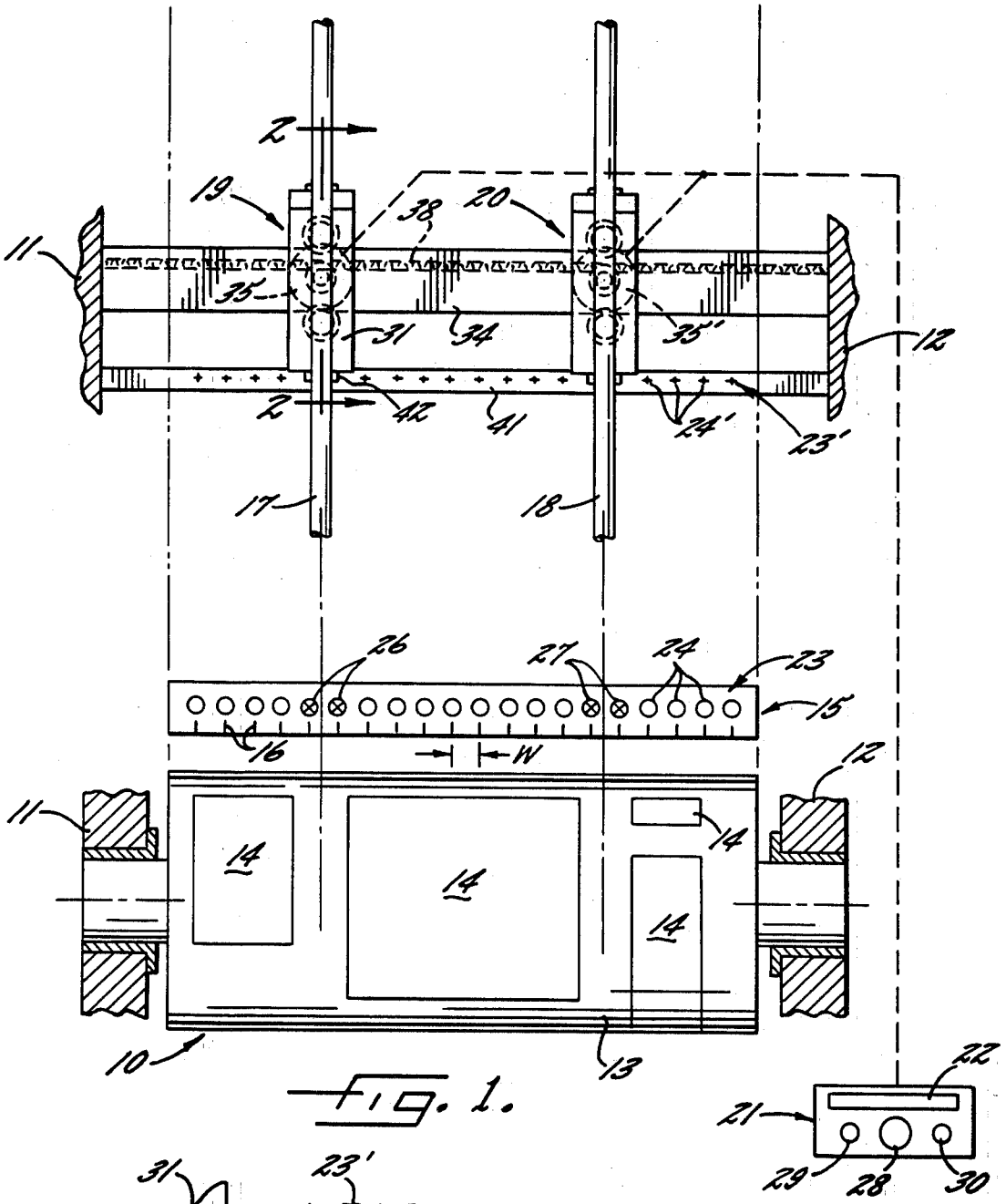
FIG. 1 is a schematic diagram of an illustrative embodiment of the present invention and shows a plate cylinder with printing areas and sheet guide means aligned with the non-printing areas, the position of each sheet guide being visible from an LED display and being remotely adjustable at a central control panel.

Turning now to the drawings, there is shown in FIG. 1 an illustrative embodiment of the present invention employed in connection with a rotary printing machine. As is conventional, the rotary printing machine includes a plate cylinder generally designated 10 journaled to the side frames 11, 12 of the printing machine, which is not shown in greater detail. A printing plate 13 is clamped to the plate cylinder 10 and includes a number of distinct printing areas 14. These printing areas, for example, result in columns of printed text on the printed sheet (not shown). In a conventional printing machine, ink is applied or regulated to a number of discrete inking zones laterally or axially spaced across the plate cylinder 10 and printing plate 13. These zones are indicated in FIG. 1 by a scale generally designated 15 including a number of graduations or marks 16 defining the boundaries between the inking zones. As is evident in FIG. 1, a number of the zones do not include any printing areas 14 on the printing plate 13. These zones will hereinafter be referred to as non-printing zones.

In order to prevent fed sheets from flapping as the sheets (not shown) are conveyed through the printing machine, left and right sheet guides 17, 18 are positioned in non-printing zones. In a printing machine which prints on both sides of the fed sheets, it is especially important to have the sheet guides 17, 18 positioned in non-printing zones because otherwise contact of the sheet guides with the printed sheet may cause smearing of the printed ink.

In accordance with the primary aspect of the present invention, the sheet guides 17, 18 are provided with respective remote control means generally designated 19 and 20, respectively, for adjusting the lateral positions of the guides. These remote control means 19, 20 are controllable from an external central location or control panel generally designated 21. Moreover, sensing means 23' (further shown and described in connection with FIGS. 2 and 3) determine the lateral positions or inking zones including the sheet guides 17, 18 and further sense when the guides are approximately centered within the zones. The sensing means drive optical displays or indicators 22, 23 which correlate the sensed lateral positions of the sheet guides 17, 18 with the respective inking zones. Therefore, the sheet guides 17, 18 can be remotely adjusted to be approximately centered within selected non-printing zones.

In the display 23, individual light-emitting diodes (LED's) 24 light up on the reference strip 15 at the positions of the guides 17, 18. In particular, when a guide is approximately centered within a particular inking zone, two LED's light up defining the boundaries of the respective zone. As shown in FIG. 1, for example, LED's 26 light up indicating the centering of the left guide 17, and LED's 27 light up indicating the centering of the right sheet guide 18.

As shown in FIG. 1, it is preferable to have the display 23 disposed as shown directly beside the plate cylinder 10, and it is also desirable to have the second optical display 22 similar to the display 23 so that the printer or operator can readjust the sheet guides from the control panel 21 when the printing machine is running. Thus, the adjustment can be checked when the printing plate 13 is clamped on the plate cylinder 10, and if an adjustment is needed it can be conducted at the control panel 21 at a central location remote from the plate cylinder 10.

In order to change the lateral position of a desired one of the sheet guides 17, 18, the control panel 21 includes a selector switch 28 for selecting a particular one of the sheet guides 17, 18 and also includes left and right push-button switches 29, 30 for commanding the selected sheet guide to traverse in either the left or right axial direction with respect to the plate cylinder 10.

Figures 2, 3, 5:
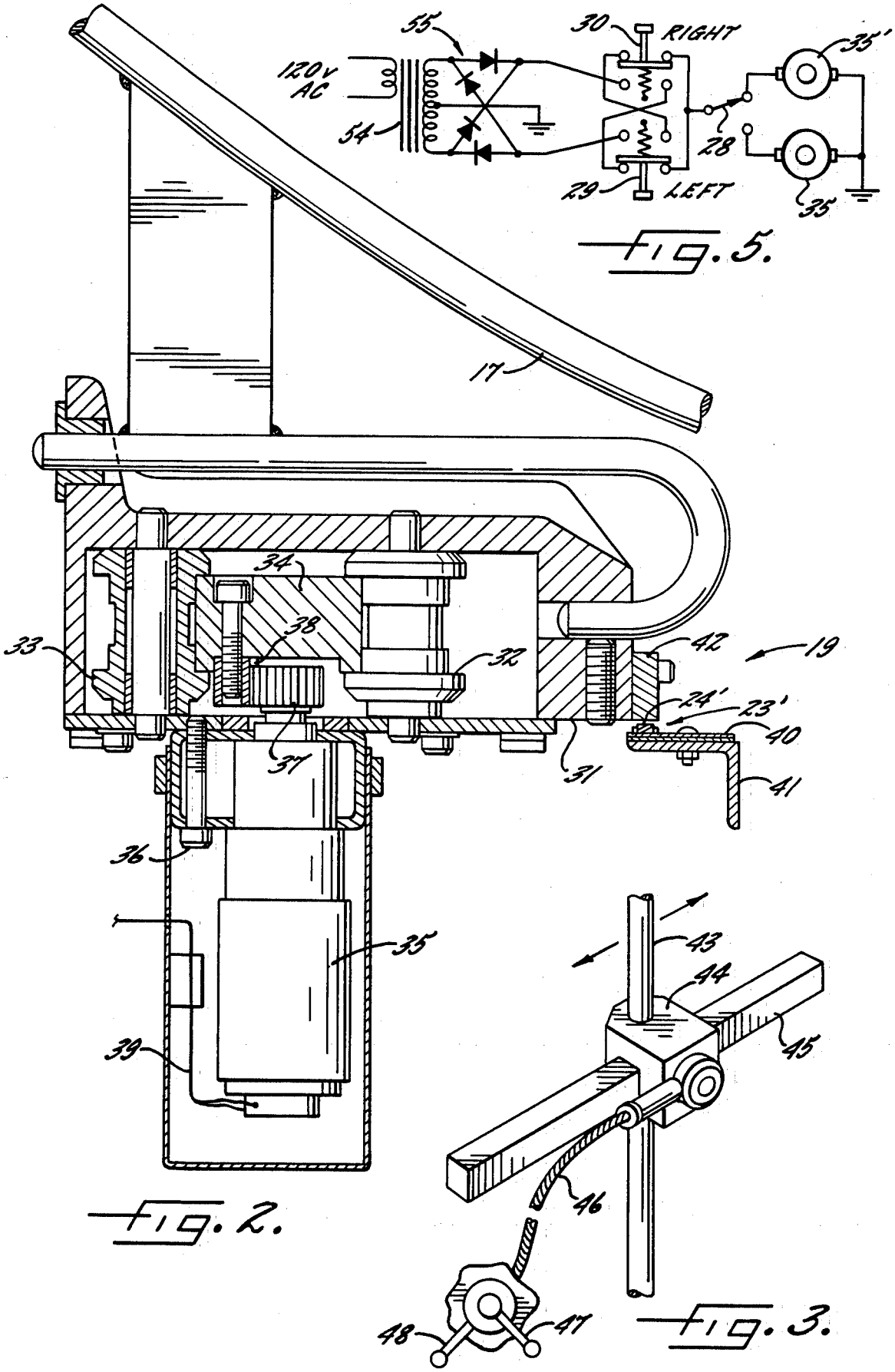
FIG. 2 is a detailed view in cross-section of a single sheet guide mounted via a control block for traversing a cross-member, and being laterally adjustable by an electric motor.
FIG. 3 is a perspective view of a single sheet guide adjustable via a flexible shaft from a hand lever or wheel.
FIG. 5 is a schematic diagram of an electrical circuit for driving two electric motors for adjusting left and right sheet guides.

Turning now to FIG. 2, there is shown the left sheet guide 17 and its lateral adjusting means 19 in cross-section. The sheet guide 17 in the form of a rod is mounted to a control block 31 which is mounted or journaled via rollers 32, 33 to a traversing rail or cross-member 34. As shown in FIG. 1, the traversing rail 34 is generally parallel to the axis of the plate cylinder 10 and is mounted at its ends to the side frames 11, 12 of the printing machine. To remotely adjust the lateral position of the sheet guide 17, an electric motor 35 is secured via at least one screw 36 to the control block 31. The electric motor 35 drives a pinion gear 37 which meshes with a toothed rack 38 extending along the traversing rail 34. The electric motor 35 is, for example, a permanent magnet DC motor so that its direction is determined by the polarity of the voltage applied to the motor via leads or wires 39. Therefore, by appropriate selection of the voltage applied to the motor 35, the control block 31 is driven in the desired lateral direction along the traversing rail 34.

The sensing means 23' is also shown in FIG. 2, and includes a linear array of individual sensors 24', one sensor 24' being provided for a corresponding one of the LED's or optical indicators 24 (see FIG. 1). The sensors 24' are positioned at the boundaries of the inking zones and are mounted on a cross-member 41 parallel to the traversing rail 34. As shown in FIG. 2, the cross-member 41 is an angle iron and the sensors 24 are mounted on a printed circuit board 40 fastened to the top surface of the angle iron. The sensors 24' detect the presence of an overlapping bar 42, as further shown and described below in connection with FIG. 4.

Turning to FIG. 3, there is shown an alternative manually-actuated adjustment mechanism for setting the lateral positions of sheet guides. The sheet guide 43, for example, is mounted in a control block 44 journaled to a traversing rail 45. Lateral movement of the control block 44 with respect to the traversing rail 45 is driven in a similar fashion by a rack and pinion (not shown) wherein the pinion is driven by a flexible shaft or Bowden cable 46. The Bowden cable 46 leads from the control block 44 to a special hand lever 47. The sheet guide 43, for example, is a left sheet guide operated by the handle 47 which is used in conjunction with a second handle 48 attached to a control block (not shown) for a right sheet guide (not shown). The Bowden cable construction shown in FIG. 3 is much cheaper than the construction shown in FIG. 2 using a drive motor 35. The manual adjustment can, however, be carried out just as simply, reliably and quickly during operation by the printer and a check can be carried out directly after the adjustment to see whether individual prints on the sheets do or do not smear at the sheet guide means 43. When used in conjunction with the Bowden cable construction, the reference strip 15 and the LED display 23 is particularly important and greatly simplifies the adjustment of the sheet guide 43 for the printer.

Figure 4:
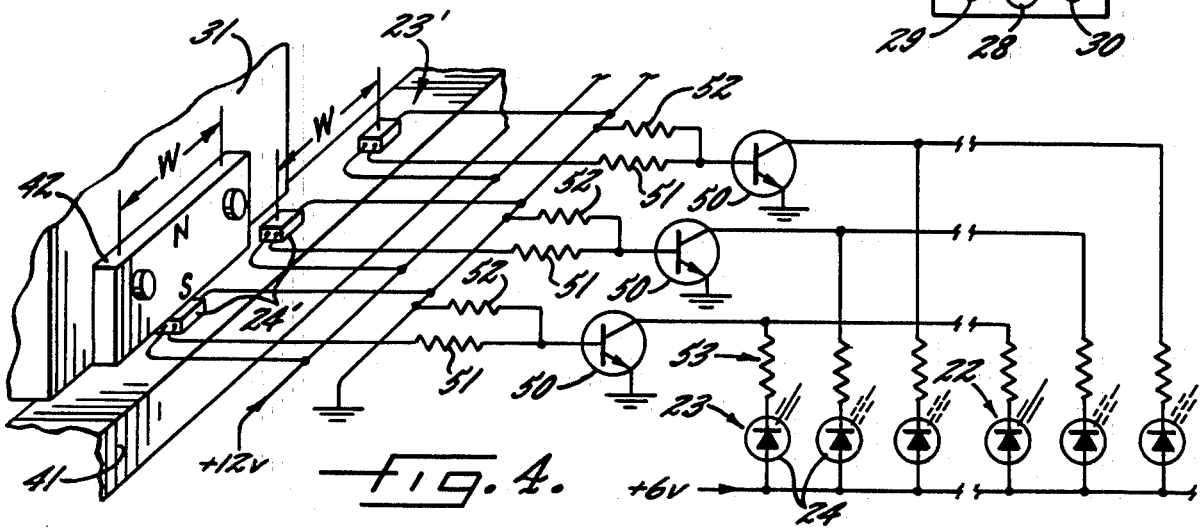
FIG. 4 is an electrical circuit diagram of one kind of means for sensing and indicating the lateral positions of the sheet guides.

Turning now to FIG. 4, there is shown a detailed view of the sensor and indicator circuits. The bar 42 is a magnet and the sensors 24' are current sourcing unipolar digital Hall effect sensors such as part number 613SS2 manufactured and sold by Micro Switch, a Honeywell Division, 11 W. Spring St., Freeport, Ill. 61032. These devices are actuated by a magnetic field of 560 gauss or less, and release when the magnetic field drops at least to 185 gauss for a temperature range of 0° to 70° Centigrade. The Hall effect element is a tiny integrated circuit within a plastic package that is only 0.21 inches square plus terminals. This particular part number requires a supply voltage of 6 to 16 volts, and thus can be supplied by a standard 12 volt power supply without worry of variation in supply voltage. When these devices are activated, they provide a 1.5 volt output signal sourcing up to 10 milliamperes. The integrated circuit packages have four output leads, including a power supply lead, a ground lead, and an output lead.

For driving at least two LED displays 22, 23, the source current from the Hall effect sensors 24' is just a bit too small. Therefore, driver transistors 50 are used to amplify the source currents. The source current from the Hall effect sensors is limited by series resistors 51 which are preferably about 470 ohms. So that the driver transistors 50 are not turned on by leakage currents, the bases of the transistors 50 are shunted to ground by resistors 52, of approximately 4.7K ohms. When the south pole of the magnet 42 overlaps a respective Hall effect sensor 24', the respective sensor sinks at least one milliampere of current to its respective driver transistor 50, which is capable of sinking up to about 100 milliamperes. The sinking of current to the respective driver transistor 50 is divided and limited between its respective LED's 24 in the two displays 22, 23 by series resistors 53. Since the LED's 23 typically operate at a relatively low voltage, it is preferable that the LED's 24 are powered by a relatively low supply voltage such as six volts. For a current of approximately 40 milliamperes through each light-emitting diode 24, the series resistors 53 should have a value of approximately 120 ohms. The values of the resistors 51, 52, and 53 can be increased or decreased, however, to obtain a proportionally smaller or larger current supply to the LED's 24.

It should be noted that it is of particular importance that the length of the magnet 42 is approximately equal to or slightly greater than the width W of the inking zones. It should be evident that since the Hall effect sensors 24' are spaced by this width W, the condition of centering or alignment of the sheet guides 17, 18 in their respective nonprinting zones is indicated when the magnet 42 activates two adjacent Hall effect sensors 24'. The length of the magnet, however, should not excessively exceed the width W of the inking zones or else the sheet guides 17, 18 cannot be centered in their respective non-printing zones with sufficient precision merely by inspection of the display 22 when their respective motors 35 are energized by depressing either the left or right push-button switch 29, 30 respectively (see FIG. 1).

For the manual embodiment shown in FIG. 3, the overall cost savings of that approach may be dwarfed by the relatively expensive sensor electronics shown in FIG. 4. Hall effect sensors are preferred because they are contactless and hence are very reliable. It should be noted, however, that the magnet 42 shown in FIG. 4 could be replaced by a copper or brass bar and the Hall effect sensors 24' could be replaced by small leaf springs to contact the brass or copper bar when they are overlapped by the bar. The closing of a circuit from the leaf springs to the bar, in other words, is analgous to the proximity sensing of the Hall effect sensors 24' when they are overlapped by the magnet. The copper or brass bar 42 would be grounded to the printing machine frame 11 through the control block 31 and the traversing bar 34. Hence, the leaf springs could be directly wired, in lieu of the collectors of the driver transistors 50, to the LED current limiting resistors 53 in FIG. 4. In other words, closing of a leaf spring with the brass or copper bar would provide a sinking of current to drive a respective LED 24. The bottom surface of the copper or brass bar 42 could be silver plated to insure relatively reliable electrical contacts with the leaf springs. According to another variation, the Hall effect sensors 24' could be replaced by micro-switches having leaf spring or roller type actuating arms. The actuating arms would be actuated upon contact with the bar 42. This variation, however, would probably be as expensive as the variation shown in FIG. 4 using Hall effect sensors, but would not be as reliable.

Turning now to FIG. 5, there is shown a schematic diagram of a circuit for energizing the motors 35, 35' for the left and right adjusting mechanisms 19, 20 (see FIG. 1). The motors 35, 35' are preferably low voltage motors rated at, for example, 12 volts. For generating a supply voltage of 12 volts DC, the standard line voltage of approximately 120 volts AC is dropped by a 24 volt center-tapped filament transformer 54. The center-tapped transformer 54 is used in conjunction with a full-wave bridge rectifier circuit generally designated 55 to supply 12 volts of either positive or negative polarity with respect to the center tap which is grounded. A dual polarity supply is preferred so that simple push-button switches 29, 30 can be used for reversing the polarity of the voltage applied to the motors 35, 35'. The push-button switches 29, 30 each have a pair of normally open contacts and a separate pair of normally closed contacts. The normally open contacts are used for selecting the polarity of the voltage to be applied to the motors 35, 35' and the normally closed contacts are used to provide a safety interlock so that a short circuit does not result when both of the push buttons 29, 30 are simultaneously depressed. A single-pole double-through switch 28 is used for selecting either the motor 35 in the adjustment mechanism 19 for the left sheet guide 17, or the motor 35' in the adjusting mechanism 20 for the right sheet guide 18.

In view of the above, a remote control and remote sensing system has been described to enable sheet guide means to be quickly adjusted laterally to the gaps between printed areas. The sheet guides are easily adjusted by a single operator at a central location or control panel outside of the printing machine. Light-emitting diode arrays have been described which not only show the zone boundaries and the relative lateral positions of the sheet guides, but which also rather precisely indicate the centering of the sheet guide within a desired nonprinting zone. A low cost embodiment has been disclosed using manually driven flexible cables and contact sensors, and the preferred embodiment has been described using electric motors for adjustment and contactless Hall effect sensors.

What is claimed is:

1. An arrangement in sheet-fed machines of the kind having lateral inking zones and laterally adjustable sheet guide means, wherein the improvement comprises means for adjusting the lateral position of the sheet guide means from a location outside of the sheet-fed machine, and means for sensing and displaying the lateral position of the sheet guide means in direct comparison with the lateral inking zones, so that the sheet guide means are adjustable from the location outside of the sheet-fed machine to be within selected inking zones.

2. The arrangement as claimed in claim 1, wherein the sheet-fed machine is a rotary printing machine having a plate cylinder, and a reference strip having a graduated optical display is disposed immediately adjacent the plate cylinder so that the optical display indicates the position of the sheet guide means in relation to the plate cylinder.

3. The arrangement as claimed in claim 1, wherein said means for adjusting includes a control panel at said location outside of the sheet-fed machine, said control panel including a reference strip graphically representing the inking zones and having optical indicators indicating the position of the sheet guide means.

4. The arrangement as claimed in claim 1, wherein the sheet guide means comprise at least two laterally spaced sheet guides mounted for lateral traversing along a cross-member.

5. The arrangement as claimed in claim 4, wherein the sheet guides are mounted to respective drive blocks journalled for lateral traversing along said cross member.

6. The arrangement as claimed in claim 1, wherein the sheet guide means comprise at least two laterally spaced sheet guides mounted on a toothed cross-member via respective drive blocks including respective electric motors driving respective gears meshing with the teeth of said toothed cross-member.

7. The arrangement as claimed in claim 1, wherein the sheet guide means are laterally adjustable by means of a flexible shaft manually powered by an external hand lever.

8. The arrangement as claimed in claim 1, wherein the sheet guide means includes at least one sheet guide, and said means for sensing and displaying includes a linear array of optical indicators, each indicator representing a respective boundary between adjacent inking zones, and two adjacent ones of the optical indicators being simultaneously activated to indicate said sheet guide being adjusted approximately at the center of the inking zone defined by the boundaries represented by the respective activated adjacent optical indicators.

9. The arrangement as claimed in claim 1, wherein the sheet guide means includes at least two sheet guides driven laterally by respective electric motors which are adjustable from a control at said location outside of the sheet-fed machine.

10. The arrangement as claimed in claim 1, wherein the means for adjusting include a control panel at said location outside of the sheet fed machine, said control panel having a digital display indicating the lateral position of the sheet guide means and push buttons for selectively activating lateral movement of the sheet guide means along a chosen one of the two lateral directions.

11. An arrangement in sheet-fed printing machines of the kind having lateral inking zones, laterally adjustable sheet guide means, and means for printing on both sides of the fed sheets, the sheet guide means being laterally adjusted to fall within inking zones corresponding to non-printed areas on the sheet free of ink so that the sheet guide means do not smear the ink printed on the fed sheets, wherein the improvement comprises, in combination, means for adjusting the lateral position of the sheet guide means from a central location outside of the sheet-fed machine, and means for sensing and displaying the lateral position of the sheet guide means in correlation with the lateral inking zones, so that the sheet guide means are adjustable from said central location outside of the sheet fed machine to be approximately centered within selected ones of the inking zones corresponding to non-printing areas on the sheet free of ink.

12. The arrangement as claimed in claim 11, wherein the sheet-fed machine is a rotary printing machine having a plate cylinder and a reference strip having a graduated LED display is disposed immediately adjacent the plate cylinder so that the optical display indicates the position of the sheet guide means in relation to the plate cylinder at any given time.

13. The arrangement as claimed in claim 11, wherein said means for adjusting includes a control panel at said central location outside of the sheet-fed machine, said control panel including a graduated LED display representing the inking zones and having activated LED's indicating the position of the sheet guide means.

14. The arrangement as claimed in claim 11, wherein the sheet guide means comprise at least two laterally spaced sheet guides mounted for lateral traversing along a cross-member.

15. The arrangement as claimed in claim 14, wherein the sheet guides are mounted to respective drive blocks journalled for lateral traversing along said cross member.

16. The arrangement as claimed in claim 11, wherein the sheet guide means comprise at least two laterally spaced sheet guides mounted on a toothed cross-member via respective drive blocks including respective electric motors driving respective gears meshing with the teeth of said toothed cross-member.

17. The arrangement as claimed in claim 11, wherein the sheet guide means are laterally adjustable by means of a flexible shaft manually powered by an external hand lever.

18. The arrangement as claimed in claim 11, wherein the sheet guide means includes at least one sheet guide, and said means for sensing and displaying includes a linear array of optical indicators, each indicator representing a respective boundary between adjacent inking zones, and two adjacent ones of optical indicators being simultaneously activated to indicate said sheet guide being adjusted approximately at the center of the inking zone defined by the boundaries represented by the respective activated adjacent optical indicators.

19. The arrangement as claimed in claim 11, wherein the sheet guide means includes at least two sheet guides driven laterally by respective electric motors which are adjustable from a control at said location outside of the sheet-fed machine.

20. The arrangement as claimed in claim 11, wherein the means for adjusting include a control panel at said location outside of the sheet fed machine, said control panel having a digital display indicating the lateral position of the sheet guide means and push buttons for selectively activating lateral movement of the sheet guide means along a chosen one of the two lateral directions.

* * * * *